US008463144B2

(12) United States Patent
Yamamoto et al.

(10) Patent No.: US 8,463,144 B2
(45) Date of Patent: Jun. 11, 2013

(54) IMAGE FORMING DEVICE, IDENTIFYING DEVICE, SEMICONDUCTOR INTEGRATED DEVICE, AND IDENTIFYING METHOD

(75) Inventors: Mitsufumi Yamamoto, Kanagawa (JP); Masayuki Yabuuchi, Kanagawa (JP); Yuichiro Ueda, Kanagawa (JP); Sumihiro Inokuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 351 days.

(21) Appl. No.: 13/008,108

(22) Filed: Jan. 18, 2011

(65) Prior Publication Data

US 2011/0176818 A1 Jul. 21, 2011

(30) Foreign Application Priority Data

Jan. 19, 2010 (JP) ..... 2010-009383

(51) Int. Cl.
*G03G 15/00* (2006.01)

(52) U.S. Cl.
USPC ..... 399/12; 399/13

(58) Field of Classification Search
USPC ..... 399/9, 12, 13, 24, 90, 110, 111; 347/7, 347/19, 86
See application file for complete search history.

(56) References Cited

U.S. PATENT DOCUMENTS 6,263,170 B1 * 7/2001 Bortnem ..... 399/13
6,311,025 B1 * 10/2001 Nagata et al. ..... 399/12
6,483,995 B2 * 11/2002 Iwaki et al. ..... 399/12
7,272,328 B2 * 9/2007 Ream et al. ..... 399/13

FOREIGN PATENT DOCUMENTS

JP 2002-202643 7/2002

* cited by examiner

*Primary Examiner* — Hoan Tran
(74) *Attorney, Agent, or Firm* — IPUSA, PLLC

(57) ABSTRACT

In an image forming device, a plurality of objects are detachably disposed, each of the objects having a storage area to store object-related information of the object, and configured to return, in response to an acquisition request, a signal with a voltage in a predetermined range which is distinctly different among the objects, the signal carrying the object-related information of the object. The image forming device includes a transmitting unit that transmits acquisition requests of object-related information to the objects respectively, a receiving unit that receives signals from the objects respectively, a voltage detection unit that detects a range of voltage of each of the signals received, and an identifying unit that identifies each of the objects respectively based on the ranges of voltage detected.

7 Claims, 8 Drawing Sheets

330

| CLOCK | PATTERN | | | | COLOR |
|---|---|---|---|---|---|
| | T1 | T2 | T3 | T4 | |
| CLOCK1 | 1 | 1 | 1 | 1 | Y |
| CLOCK2 | 0 | 1 | 1 | 1 | M |
| CLOCK3 | 0 | 0 | 1 | 1 | C |
| CLOCK4 | 0 | 0 | 0 | 1 | K |

IMAGE FORMING DEVICE, IDENTIFYING DEVICE, SEMICONDUCTOR INTEGRATED DEVICE, AND IDENTIFYING METHOD

BACKGROUND OF THE INVENTION

1. Field of the Invention

The present disclosure relates to an image forming device in which a plurality of objects of interest each having a storage area for storing object-related information of the object are respectively identified by an identifying device. The present disclosure relates to an identifying device provided in the image forming device, a semiconductor integrated device disposed in each object of interest, and an identifying method for an identifying device in the image forming device.

2. Description of the Related Art

Recently, in an image forming device according to the related art, such as a printer or a copier, toner information with respect to toner bottles in the image forming device is input to a main controller of the device, and the serviceability of the image forming device is managed based on the information in order to improve the quality of image and improve the operability of the device. The toner information here may contain, for example, a serial number of each toner bottle, toner color information, a toner remaining quantity of each toner bottle, etc.

Typically, in a network printer connected to a personal computer (PC) via a network, the toner information is input to a main controller of the network printer. In order to detect the toner information for each of the toner bottles, the network printer is arranged so that the information of replacement parts, such as toner bottles, may be input to the main controller.

In the network printer, an IC chip having a storage area for storing the toner information is disposed in each of the toner bottles. When a toner bottle in the network printer is replaced with another one, the toner information from the chip disposed in the toner bottle is input to the main controller of the network printer. When the input of the toner information is detected at the main controller, the network printer transmits the toner information to the PC via the network. The PC identifies the color of each toner bottle based on the color information contained in the received toner information, and the toner information, including the toner remaining quantity of each toner bottle, etc., is displayed on a display monitor so that a user is notified of a next replacing time of the toner bottle.

A drawer connector which interconnects the toner bottle and the main controller is used to perform data communication between the toner bottle and the main controller. The operation of the drawer connector is interlocked with the attaching operation of a toner bottle, and the drawer connector functions to establish electric connection between the main controller and a recording medium of the toner bottle in which the toner information is stored. The recording medium is disposed in the toner bottle.

When the drawer connector or the like is used to perform the communication of information between the main controller and the recording medium in the toner bottle, there has been a possibility that a loose connection between the recording medium and the main controller may arise. In addition, when carrying out inventory control of image forming device component parts in a warehouse, it has been necessary to supply power to all the IC chips of the toner bottles in which the recording mediums are disposed and write information to each recording medium. Such inventory control requires time and effort.

To eliminate the problem, in another image forming device according to the related art, the toner information stored in the recording medium of each of the toner bottles is transmitted to the main part of the image forming device by making use of RFID (radio frequency identity) communication. RFID communication is a contact-less solution. In this age forming device, the state of each of the toner bottles is managed for each color based on the color information of the toner, the serial number of the toner bottle, and the toner remaining quantity of the toner bottle, contained in the toner information.

Japanese Laid-Open Patent Publication No. 2002-202643 discloses an image forming device which is adapted to be managed in an optimized manner even after a component part thereof is replaced with a replacement part.

In the above-described image forming device according to the related art, the color of the toner bottle is identified based on the toner color information contained in the toner information read from the recording medium, and the state of the toner bottles of the respective colors is managed. For this reason, in the image forming device according to the related art, it has been necessary to store, in the recording medium provided in the toner bottle, the toner information containing the color information of the toner bottle.

However, in recent years, in consideration of the cost, it is desired to reduce the amount of information stored in the recording medium, and thereby reducing the capacity of the storage area in the recording medium.

SUMMARY OF THE INVENTION

In one aspect, the present disclosure provides an image forming device, an identifying device, a semiconductor integrated device, and an identifying method which are adapted to effectively reduce the amount of information to be stored in the storage areas provided in the toner bottles.

In an embodiment which solves or reduces one or more of the above-mentioned problems, the present disclosure provides an image forming device in which a plurality of objects of interest are detachably disposed, each of the plurality of objects having a storage area to store object-related information of the object, and a returning unit to return, in response to an acquisition request, a signal with a voltage in a predetermined range which is distinctly different among the plurality of objects, the signal carrying the object-related information of the object, the image forming device including: a transmitting unit to transmit acquisition requests of object-related information to the plurality of objects respectively; a receiving unit to receive signals from the plurality of objects respectively; a voltage detection unit to detect a range of voltage of each of the signals received by the receiving unit; and an identifying unit to identify each of the plurality of objects, respectively, based on the ranges of voltage detected by the voltage detection unit.

Other objects, features and advantages of the present disclosure will become more apparent from the following detailed description when read in conjunction with the accompanying drawings.

DETAILED DESCRIPTION OF THE. PREFERRED EMBODIMENTS

A description will be given of embodiments of the present disclosure with reference to the accompanying drawings.

Figure 1:
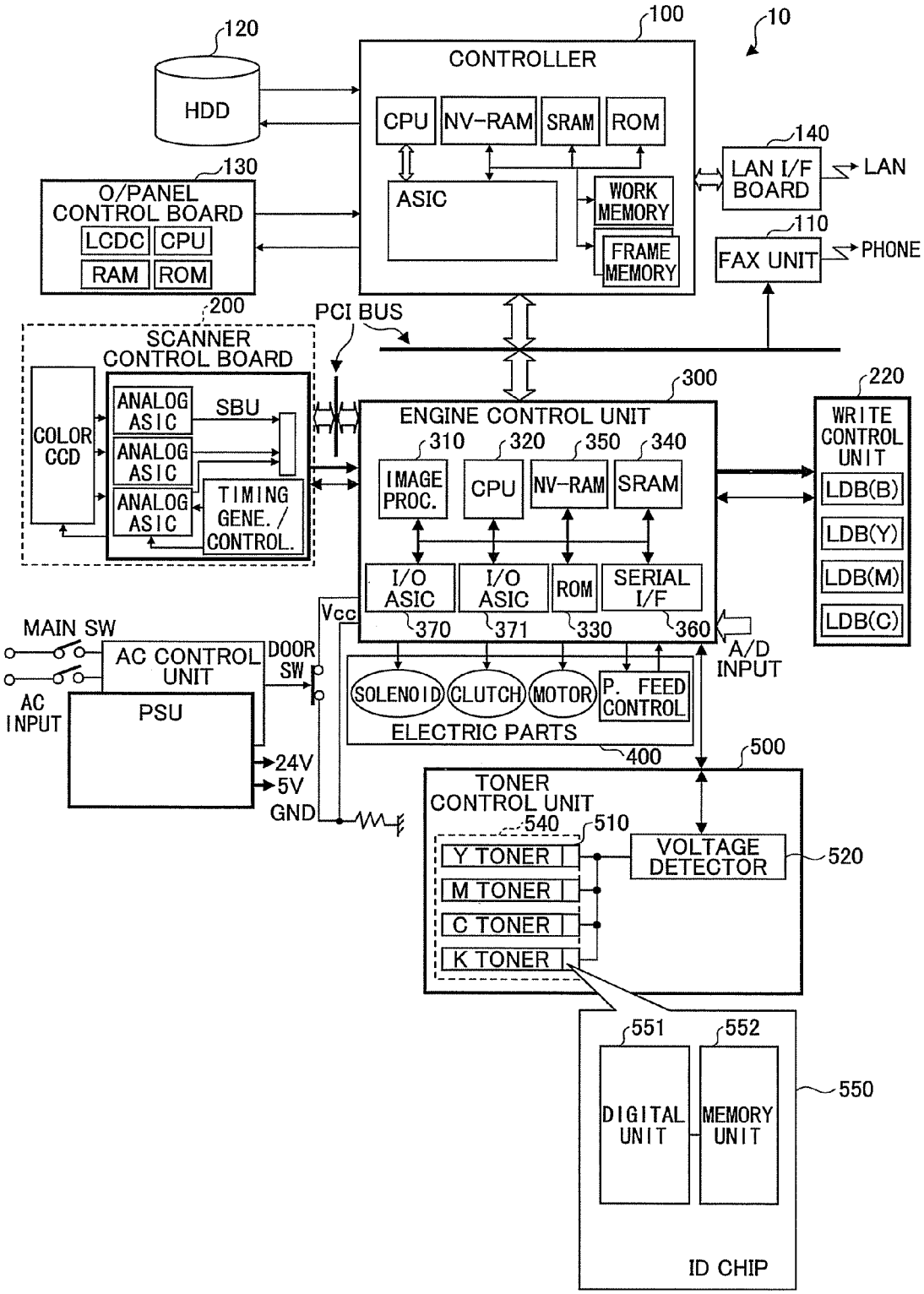
FIG. 1 is a diagram for explaining an image forming device of a first embodiment of the present disclosure.

FIG. 1 is a diagram for explaining an image forming device of a first embodiment of the present disclosure. In the first embodiment of the present disclosure, replacement parts, for example, toner bottles of four different colors, are referred to as a plurality of objects of interest) and an image forming device is arranged to identify the respective colors of the toners of the 4-color toner bottles based on a specific range of a voltage of a signal received from each toner bottle.

The image forming device 10 of this embodiment includes a controller 100, a scanner control unit 200, an engine control unit 300, and a fax unit 110, and these elements are interconnected by a PCI (peripheral components interconnect) bus.

In the image forming device 10, the controller 100 receives a request of image formation operation, and sets up the image formation operation. The scanner control unit 200 performs drive controlling of a scanner engine. The engine control unit 300 performs drive controlling of a printer engine.

The controller 100 of this embodiment carries out the control of image formation, user interface, mode setting, and various applications, such as a copier and a printer, etc. The controller 100 includes: an ASIC (application-specific integrated circuit) which performs image formation; a CPU (central processing unit) which performs various kinds of processing operation; an ROM (read-only memory) which stores the control programs permanently; an SRAM (static random access memory) which stores various kinds of information temporarily; and an NV-RAM (nonvolatile RAM) which stores the setting information of all the operating conditions of the image forming device 10. The controller 100 is connected to an HDD 120, an operation panel control board 130, and a LAN interface board 140. The HDD 120 stores the data for processing. The operation panel control board 130 provides the user interface. The LAN interface board 140 transmits to an external communication device (or receives from the external communication device) information via a local area network.

The controller 100 of this embodiment receives a request of image formation operation from an external device through the operation panel control board 130 or the LAN interface board 140, performs the image formation operation, and transmits the image (which is generated as a result of the image formation operation) to the engine control unit 300 via the PCI bus.

The scanner control unit 200 of this embodiment reads an original image of a recording sheet (which is placed by the user) using the color CCD (charge coupled device) and transmits the read image to the image processing unit 310 of the engine control unit 300 via the PCI bus. In the scanner control unit 200, the SBU (scanner board unit) performs the I/O (input/output) control and the image transmission control of the scanner and controls various electric parts 400, such as motors, while the color CCD operates.

The engine control unit 300 of this embodiment includes an image processing unit 310, a CPU 320, a ROM 330, an SRAM 340, an NV-RAM 350, a serial interface 360, an I/O ASIC 370, and an I/O ASIC 371.

The CPU 320 mainly performs various kinds of processing operation. The ROM 330 stores the control programs permanently. The SRAM 340 stores a variety of information temporarily. The NV-RAM 350 stores the setting information of various kinds of operation. The I/O ASIC 370 and the I/O ASIC 371 perform the I/O control of various electric parts. The serial interface 360 communicates with any of the write control unit 210, the image processing unit 310, the I/O ASIC 370, and the I/O ASIC 371.

Each of the I/O ASIC 370 and the I/O ASIC 371 includes a serial communication interface, an ADC (analog-to-digital converter) unit, and an I/O interface. Each of the I/O ASIC 370 and the I/O ASIC 371 of this embodiment receives request signals from the CPU 320 in the engine control unit 300 via the bus or the serial interface, and controls the electric parts 400, including solenoids, clutches, motors, feed control parts, and sensor input parts.

The image sent from the controller 100 or the scanner control unit 200 via the PCI bus is transmitted to the write control unit 220 by the engine control unit 300. The write control unit 220 writes the received image to a recording sheet as a pattern, so that the write control unit 220 performs the print operation or the copy operation. On the other hand, the image read by the scanner control unit 200 is transmitted to the controller 100 via the engine control unit 300, and the image from the controller 100 is transmitted to the external PC via the LAN interface board 140, so that the scanner control unit 200 performs the scanner operation.

The toner control unit 500 of this embodiment is connected to the engine control unit 300. The toner control unit 500 includes a connector 510 and a voltage detector 520.

The connector 510 connects the respective toner bottles 540 to the toner control unit 500. The connector 510 enables the transmitting/receiving of information between the ID (identification) chips 550 (provided in the respective toner bottles 540) and the toner control unit 500. The information transmitted and received between each ID chip 550 and the toner control unit 510 is toner-related information (which will be called toner information) of the corresponding toner bottle. For example, the toner information here may be information which contains: color information indicating a color of a toner; a serial number for identifying a toner bottle; remaining quantity information indicating the remaining quantity of the toner in the toner bottle; and the date of manufacture of the toner bottle. As will be explained below, the toner information in this embodiment does not contain the color information of the toner.

The voltage detector 520 of this embodiment detects a range of voltage of each of signals indicating the toner information received from the connector 510. The CPU 320 of this embodiment is arranged to identify the color of each toner bottle 540 based on the range of the voltage of each of the signals indicating the toner information detected by the voltage detector 520. The details of the voltage detector 520 and the details of the identifying of the color of each toner bottle 540 performed by the CPU 320 will be described later.

Each of the ID chips 550 includes a digital unit 551 and a memory unit 552. The digital unit 551 performs the control of protocol analysis and execution. The digital unit 551 generates a voltage in a predetermined range, causes the signal indicating the toner information to superimpose on a signal with the voltage in the predetermined range, and transmits the resulting signal to the toner control unit 500. The predetermined range of the generated voltage is set up beforehand by each of the ID chips 550 of the respective colors based on respective reference voltages Vref1, Vref2, Vref3 and Vref4 of the voltage detector 520 which will be described later. The memory unit 552 of each of the ID chips 550 provides a storage area in which the toner information for each color is stored.

The toner bottle 540 of this embodiment includes a Y toner bottle 540Y, an M toner bottle 540M, a C toner bottle 540C, and a K toner bottle 540K. In the following, when not specifying the color of each toner, these toner bottles will be collectively referred to as the toner bottle 540.

Similarly, the ID chip 550 of this embodiment includes an ID chip 550Y provided for the Y toner bottle 540Y, an ID chip 550M provided for the M toner bottle 540M, an ID chip 550C provided for the C toner bottle 540C, and an ID chip 550K provided for the K toner bottle 540K. In the following, when not specifying the color of each toner, these ID chips will be collectively referred to as the ID chip 550.

Similarly, the connector 510 of this embodiment includes a connector 510Y which connects the Y toner bottle 540Y and the ID chip 550Y, a connector 510M which connects the M toner bottle 540M and the ID chip 550M, a connector 510C which connects the C toner bottle 540C and the ID chip 550C, and a connector 510K which connects the K toner bottle 540K and the ID chip 550K. In the following, when not specifying the color of each toner, these connectors will be collectively referred to as the connector 510.

In this embodiment, the signals indicating the toner information and having distinctly different ranges of voltage are transmitted from the ID chips 550 of the toner bottles 540 to the toner control unit 500. The toner control unit 500 detects the range of voltage of each of the signals indicating the toner information received from the ID chips 550, by using the voltage detector 520. Hence, the CPU 320 identifies the color of each of the toner bottles 540 based on the detection results provided by the voltage detector 520. In this embodiment, the color of each of the toner bottles 540 can be identified by the above-described composition, without using the color information of each of the toner bottles 540. Accordingly, it is not necessary for this embodiment to store the color information of each of the toner bottles 540 in the storage area of the memory unit 552 of each ID chip 550, and the capacity of each of the storage areas in the ID chips 550 can be reduced.

Figure 2:
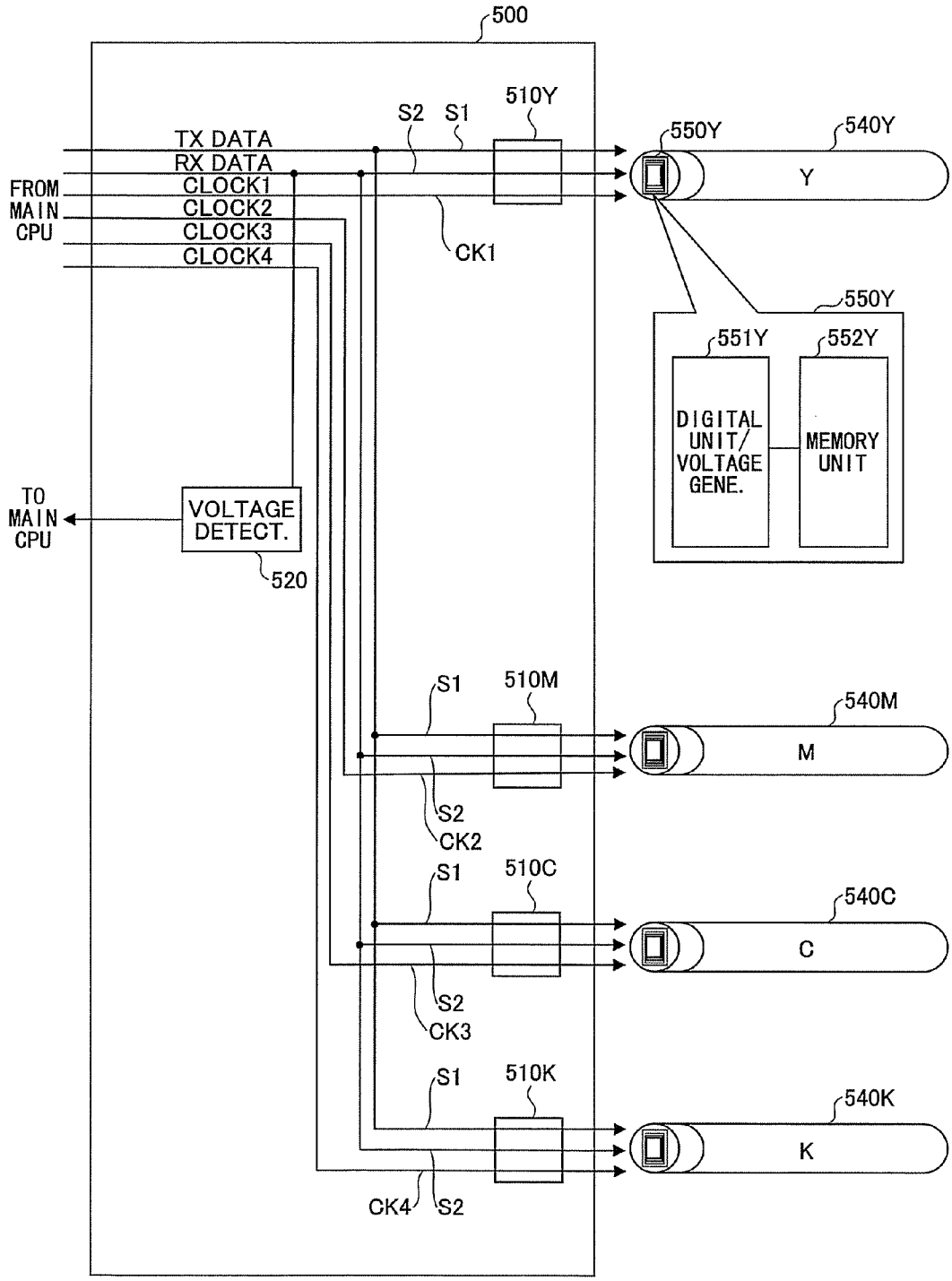
FIG. 2 is a diagram for explaining a toner control unit in the image forming device of the first embodiment.

Next, with reference to FIG. 2, the toner control unit 500 in the image forming device of the present embodiment will be described. FIG. 2 is a diagram for explaining the toner control unit of the first embodiment.

As illustrated in FIG. 2, a signal line Si, a signal line S2, and clock signal lines CK are connected to each connector 510 of the toner control unit 500 of this embodiment. The signal line S1 is a signal line for supplying the transmission (TX) data from the CPU 320 to each ID chip 550. The transmission data transmitted from the CPU 320 to each ID chip 550 is an acquisition request of toner information. The signal line S2 is a signal line for transmitting the toner information (or the reception (RX) data) from each ID chip 550 to the CPU 320. The CPU 320 receives the signal indicating the toner information from each ID chip 550 via the signal line S2. Each of the clock signal lines is a clock signal line for supplying a clock signal from the CPU 320 to one of the ID chips 550.

The signal line S2 is connected to the input of the voltage detector 520. The output of the voltage detector 520 is connected to the CPU 320.

The clock signal lines CK1, CK2, CK3 and CK4 are respectively connected to the corresponding connectors 510Y, 510M, 510C and 510K of this embodiment. Different clock signals which are mutually asynchronous are supplied from the CPU 320 through the clock signal lines CK1, CK2, CK3 and CK4 to the corresponding connectors 510Y, 510M, 510C and 510K respectively.

In the following, the clock signal supplied to the connector 510Y through the clock signal line CK1 will be referred to as clock 1, the clock signal supplied to the connector 510M through the clock signal line CK2 will be referred to as clock 2, the clock signal supplied to the connector 510C through the clock signal line CK3 will be referred to as clock 3, and the clock signal supplied to the connector 510K through the clock signal line CK4 will be referred to as clock 4.

In this embodiment, an acquisition request of toner information is supplied from the CPU 320 to the ID chip 550Y in sync with the clock 1. In response to this acquisition request, the ID chip 550Y transmits a signal indicating the toner information thereof to the CPU 320 in sync with the clock 1. An acquisition request of toner information is supplied from the CPU 320 to the ID chip 550M in sync with the clock 2. In response to this acquisition request, the ID chip 550M transmits a signal indicating the toner information thereof to the CPU 320 in sync with the clock 2. The same composition is also applicable to the ID chip 550C and the ID chip 550K.

In this embodiment, the clocks 1-4 are supplied from the CPU 320 so that the acquisition requests of toner information are sequentially received at the ID chip 550Y, the ID chip 550M, the ID chip 550C, and the ID chip 550K in this order.

In each acquisition request of toner information in this embodiment, an address which indicates the location of the toner information stored in the memory unit 552 of the corresponding ID chip 550 is included. When the acquisition request of toner information is received, the ID chip 550 outputs the toner information stored at the location of the memory unit 552, indicated by the address included in the received acquisition request, to the CPU 320. In this embodiment, the toner information is stored in the memory unit 552 as a data set including a group of items of information.

Figure 3:
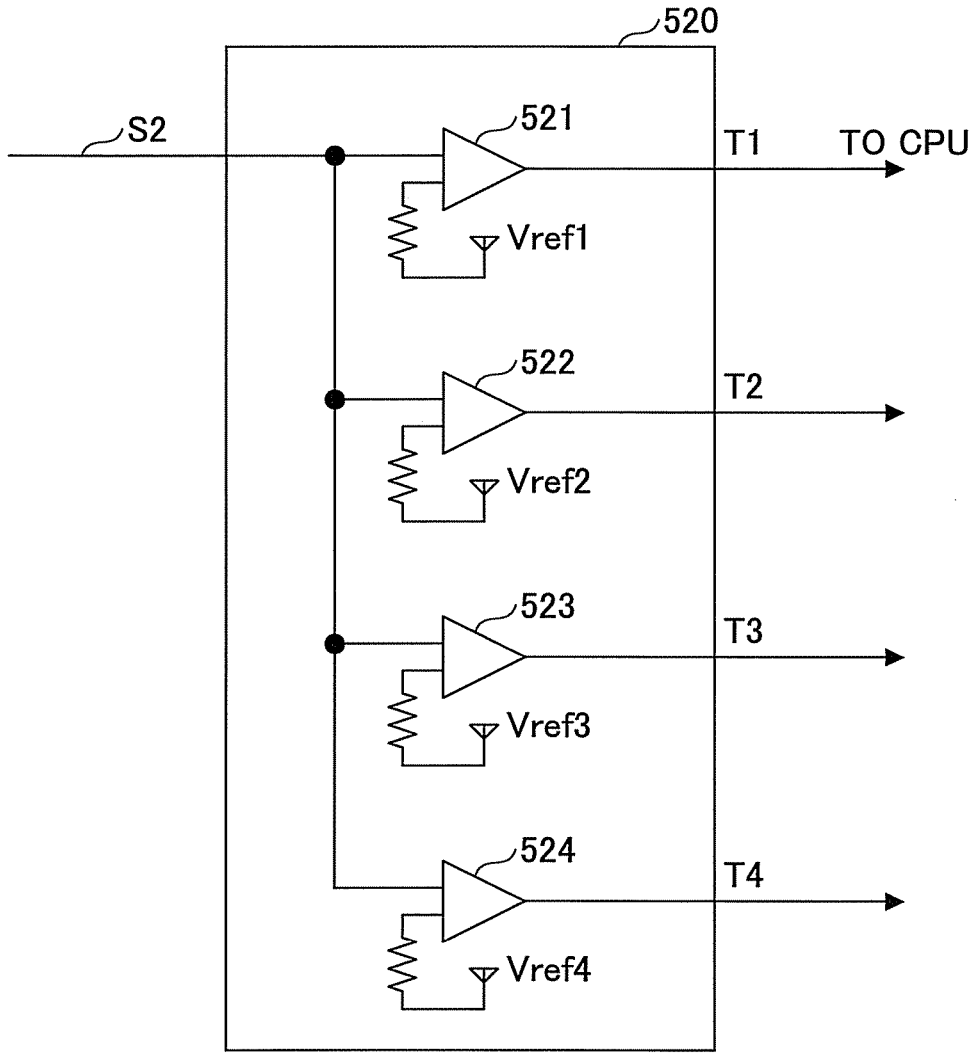
FIG. 3 is a diagram for explaining a voltage detector in the image forming device of the first embodiment.

Next, the voltage detector 520 of this embodiment will be described with reference to FIG. 3. FIG. 3 is a diagram for explaining a voltage detector in the image forming device of this embodiment.

As illustrated in FIG. 3, the voltage detector 520 of this embodiment includes comparators 521, 522, 532, and 524. The comparators 521, 522, 532, and 524 have reference voltages Vref1, Vref2, Vref3, and Vref4 respectively. A signal indicating the toner information (or the reception (RX) data) is supplied from the signal line S2 to one input of each of the comparators 521, 522, 532, and 524. The reference voltage Vref1 is supplied to the other input of the comparator 521. The reference voltage Vref2 is supplied to the other input of the comparator 522. The reference voltage Vref3 is supplied to the other input of the comparator 523. The reference voltage Vref4 is supplied to the other input of the comparator 524.

An output signal T1 is output from the output of the comparator 521. An output signal T2 is output from the output of the comparator 522. An output signal T3 is output from the output of the comparator 523. An output signal T4 is output from the output of the comparator 524. These output signals T1, T2, T3 and T4 are supplied to the CPU 320.

The range of voltage generated by the digital unit 551 of each ID chip 550 of this embodiment is set up based on the reference voltages Vref1, Vref2, Vref3, and Vref4 of the voltage detector 520. For example, the range of voltage generated by the digital unit 551Y is above the reference voltage Vref1. The range of voltage generated by the digital unit 551M is below the reference voltage Vref1 and above the reference voltage Vref2. The range of voltage generated by the digital unit 551C is below the reference voltage Vref2 and above the reference voltage Vref3. The range of voltage generated by the digital unit 551K is below the reference voltage Vref3 and above the reference voltage Vref4.

In a case where the range of voltage generated by each digital unit 551 is set up as described above, if the signal from the digital unit 551Y is received at the voltage detector 520 through the signal line S2, all of the output signals T1, T2, T3, and T4 are set to the high level (H level). If the signal from the digital unit 551M is received at the voltage detector 520, only the output signal T1 is set to the low level (L level) and the output signals T2, T3, and T4 are set to the high level (H level). If the signal from the digital unit 551C is received at the voltage detector 520, the output signals T1 and T2 are set to the L level and the output signals T3 and T4 are be set to the H level. If the signal from the digital unit 551Y is received at the voltage detector 520, the output signals T1, T2, and T3 are set to the L level and the output signal T4 is set to the H level.

Figures 4, 5:
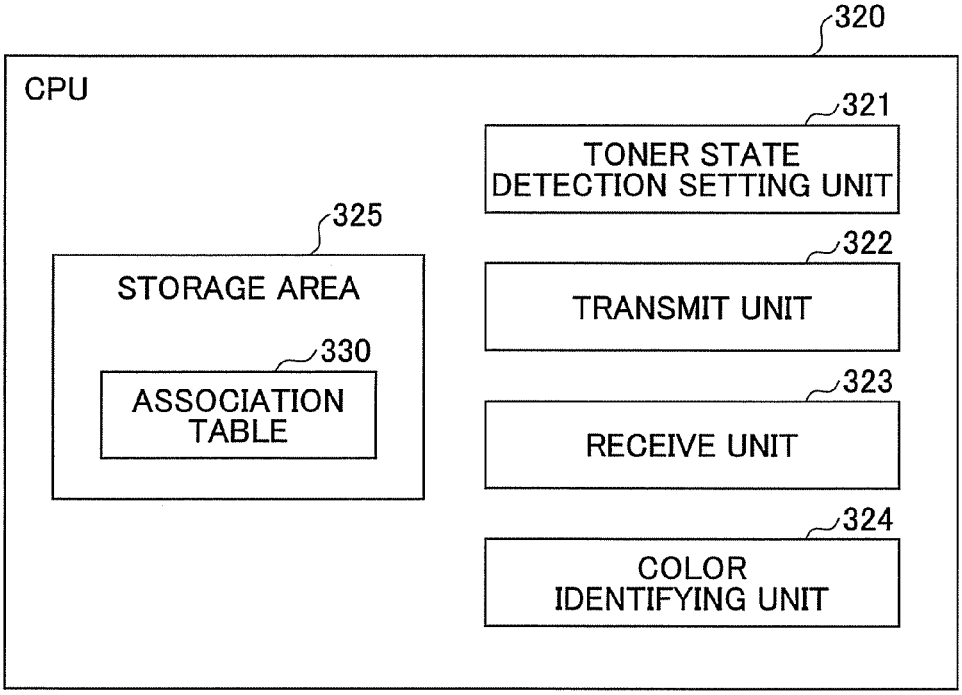
FIG. 4 is a diagram for explaining the functional composition of a CPU in the image forming device of the first embodiment.
FIG. 5 is a diagram illustrating an example of an association table in the image forming device of the first embodiment.

The CPU 320 of this embodiment identifies the color of each toner bottle 540 based on a pattern of the output signals T1, T2, T3, and T4 received from the voltage detector 520. In the following, with reference to FIG. 4, the CPU 320 which is provided in the engine control unit 320 of this embodiment will be described. FIG. 4 is a diagram for explaining the functional composition of the CPU of the first embodiment.

As illustrated in FIG. 4, the CPU 320 of this embodiment includes a toner state detection setting unit 321, a transmit unit 322, a receive unit 323, a color identifying unit 324, and a storage area 325.

The toner state detection setting unit 321 sets an event for identifying of the color of the toner bottle 540 and for detecting of the state of the toner bottle 540 when detection of the state of the toner bottle 540 is needed. In this embodiment, for example, when the power supply of the image forming device 10 is changed from an OFF state to an ON state, when the door of the accommodating part of the toner bottle 540 is opened or closed, or when a printing job performed by the image forming device 10 is completed, the toner state detection setting unit 321 is placed under the situation in which detection of the state of the toner bottle 540 is needed.

For example, when the power supply of the image forming device 10 is changed from an OFF state to an ON state or when the door of the accommodating part of the toner bottle 540 is opened or closed, there is a possibility that the toner bottle 540 has been replaced. Hence, the CPU 320 acquires the toner information of the toner bottles 540 of the four colors and determines whether the toner bottle 540 of each color is correctly disposed.

When a printing job performed by the image forming device 10 is completed, there is a possibility that the remaining quantity of the toner bottle 540 is insufficient for a next printing job. Hence, the CPU 320 acquires the toner remaining quantities of the toner bottles 540 of the four colors and determines whether the toner in the toner bottle 540 of each color runs short.

The transmit unit 322 transmits an acquisition request of toner information to the toner control unit 500 based on the demand from the toner state detection setting unit 321. The transmit unit 322 of this embodiment transmits an acquisition request of toner information to the toner bottle 540Y in sync with the clock 1 generated by the CPU 320. The transmit unit 322 transmits an acquisition request of toner information to the toner bottle 540M in sync with the clock 2. The transmit unit 322 transmits an acquisition request of toner information to the toner bottle 540C in sync with the clock 3. The transmit unit 322 transmits an acquisition request of toner information to the toner bottle 540K in sync with the clock 4. Because the clocks 1-4 in this embodiment are mutually asynchronous, the acquisition requests of toner information are transmitted to the respective toner bottles 540 at distinctly different intervals.

The receive unit 323 receives the toner information returned from the toner control unit 500.

The color identifying unit 324 identifies the color of the toner of each toner bottle 540 based on the range of voltage of the signal indicating the toner information received by the receive unit 323 and based on the association table 330 which will be described later.

An association table 330 is stored in the storage area 325. FIG. 5 is a diagram illustrating an example of the association table in the image forming device of the first embodiment.

As illustrated in FIG. 5, in the association table 330 of this embodiment, the clocks, the patterns of the output signals T1, T2, T3 and T4 from the voltage detector 520, and the colors of the toner bottles 540 are associated and stored.

Figure 6:
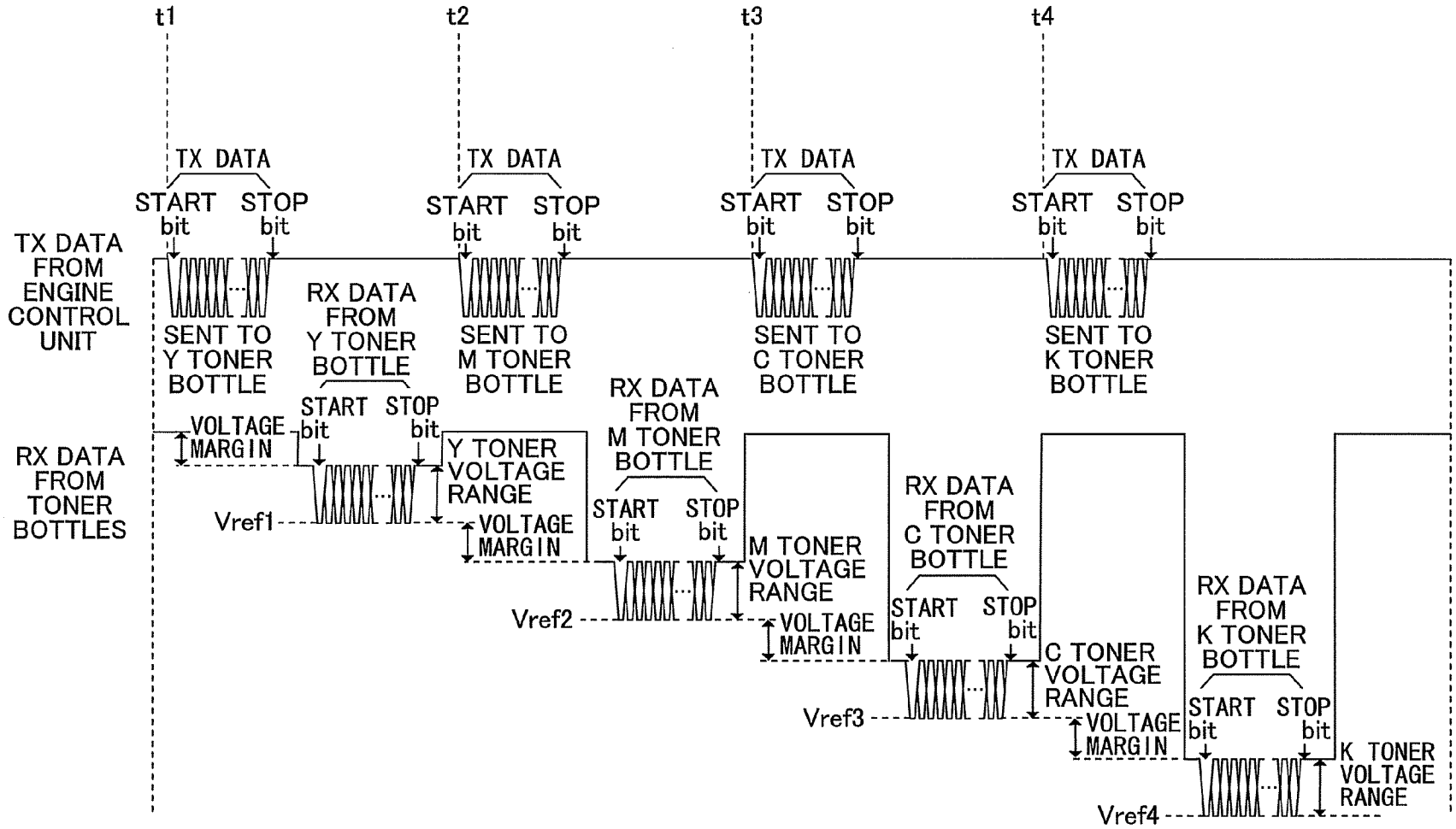
FIG. 6 is a diagram for explaining data communication between an engine control unit and a toner control unit in the first embodiment.

Next, an example of data communication between the engine control unit 300 and the toner control unit 500 will be described. FIG. 6 is a diagram for explaining an example of data communication between the engine control unit 300 and the toner control unit 500 in the image forming device of the first embodiment.

As illustrated in FIG. 6, starting from a time t1, an acquisition request of toner information is transmitted to the toner bottle 540Y by the CPU 320 in sync with the clock 1. In response to this acquisition request, the ID chip 550Y of the toner bottle 540Y transmits a signal indicating the toner information of the toner bottle 540Y, to the CPU 320. The signal received from the ID chip 550Y by the CPU 320 at this time is in a predetermined range of voltage which is above the reference voltage Vref1. Hence, all the output signals T1, T2, T3 and T4 of the voltage detector 520 are set to the H level. Therefore, by accessing the contents of the association table 330, the color identifying unit 324 of the CPU 320 identifies the color of the toner as being Y toner.

As illustrated in FIG. 6, starting from a time t2, an acquisition request of toner information is transmitted to the toner bottle 540M by the CPU 320 in sync with the clock 2. In response to this acquisition request, the ID chip 550M of the toner bottle 540M transmits a signal indicating the toner information of the toner bottle 540M, to the CPU 320. The signal received from the ID chip 550M by the CPU 320 at this time is in a predetermined range of voltage which is below the reference voltage Vref1 and above the reference voltage Vref2. Hence, only the output signal T1 of the voltage detector 520 is set to the L level and the output signals T2, T3 and T4 of the voltage detector 520 are set to the H level. Therefore, by accessing the contents of the association table 330, the color identifying unit 324 of the CPU 320 identifies the color of the toner as being M toner. Similarly, the color identifying unit 324 of the CPU 320 identifies the color of the toner of each of the toner bottle 540C and the toner bottle 540K.

As illustrated in FIG. 6, in this embodiment, a voltage margin may be provided between the voltage generated by the digital unit 551 and each of the reference voltages Vref1-4. In the example of FIG. 6, the voltage margin is provided on the side of the upper limit of the range of the voltage generated by the digital unit 551 of each toner bottle. By providing the voltage margin in this manner, confusion of the two adjacent signals on the same signal line S2 as in the example of FIG. 6 can be avoided, and it is possible to accurately identify the color of the toner based on each signal.

Figure 7:
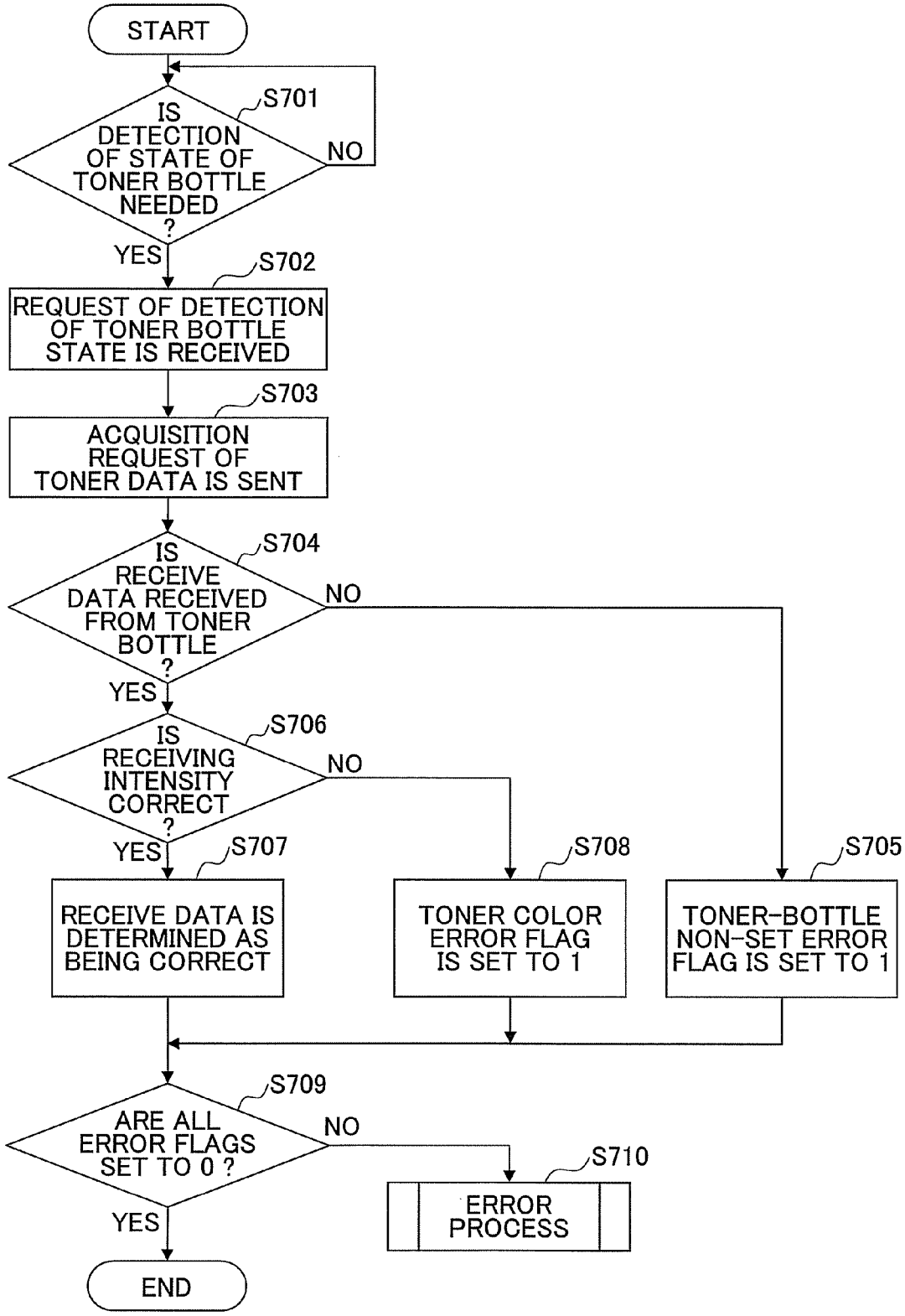
FIG. 7 is a flowchart for explaining identifying of a toner bottle performed by the image forming device of the first embodiment.

Next, the identifying of a toner bottle 540 performed by the image forming device 10 of this embodiment will be described. FIG. 7 is a flowchart for explaining the identifying of a toner bottle performed by the image forming device of the first embodiment.

Upon start of the identifying process in FIG. 7, the CPU 320 in the image forming device 10 of this embodiment determines whether detection of the state of a toner bottle 540 is needed (step S701). When it is determined in step S701 that detection of the state of the toner bottle 540 is needed, the toner state detection setting unit 321 outputs a request of detection of the state of the toner bottle 540 to the CPU 320 (step S702). In this embodiment, when the power supply of image forming device 10 is changed from an OFF state to an ON state, when the door of the accommodating part of the toner bottle 540 is opened or closed, or when a printing job by the image forming device 10 is completed, it is determined in step S701 that detection of the state of the toner bottle 540 is needed.

In response to the request of detection of the state of the toner bottle 540, the CPU 320 causes the transmit unit 322 to transmit an acquisition request of toner information to the toner control unit 500 (step S703). At this time, the transmit unit 322 transmits acquisition requests of toner information to the toner bottles 540 respectively in accordance with the clocks 1-4 which are mutually asynchronous. Thereby, the acquisition requests of toner information are transmitted to the toner bottles at distinctly different intervals.

Subsequently, the CPU 320 determines whether the reception data from the toner control unit 500 is received by the receive unit 323 (step S704). When it is determined in step S704 that the reception data is not received, the CPU 320 determines that the corresponding toner bottle is not set, and sets the toner-bottle non-set error flag to 1 (step S705).

In this embodiment, if a predetermined time has elapsed after the acquisition request is transmitted in sync with the clock 1 but the reception data is not received, then it is determined that the toner bottle 540Y is in a non-set condition. Similarly, if a predetermined time has elapsed after an acquisition request is transmitted in sync with the clock 2 but the reception data is not received, then it is determined that the toner bottle 540M is in a non-set condition.

On the other hand, when it is determined in step S704 that the reception data is received, the CPU 320 determines whether the receiving intensity of the signal indicating the reception data received from the receive unit 323 by the color identifying unit 324 is correct (step S706). Namely, the color identifying unit 324 determines the range of voltage of the signal indicating the reception data and determines whether the toner bottle 540 is set correctly.

In this embodiment, when the signal indicating the reception data received after the acquisition request is transmitted in sync with the clock 1 is in a range of voltage which is above the reference voltage Vref1, the CPU 320 determines that the receiving intensity is correct and the color identifying unit 324 identifies the color of the toner of the toner bottle 540 as being Y toner. On the other hand, when the signal indicating the reception data received after the acquisition request is transmitted in sync with the clock 1 is in a range of voltage which is below the reference voltage Vref1, the CPU 320 determines that the receiving intensity is not correct, and determines that the toner bottle of interest contains the toner of another color than the color of the toner of the toner bottle 540Y to be set.

Moreover, when a signal indicating the reception data received after an acquisition request is transmitted in sync with the clock 2 is in a range of voltage which is below the reference voltage Vref1 and above the reference voltage Vref2, the CPU 320 determines that the receiving intensity is correct and the color identifying unit 324 identifies the color of the toner of the toner bottle 540 as being M toner. On the other hand, when the signal indicating the reception data received after the acquisition request is transmitted in sync with the clock 2 is in a range of voltage which is below the reference voltage Vref2, the CPU 320 determines that the receiving intensity is not correct, and determines that the toner bottle of interest contains the toner of another color than the color of the toner of the toner bottle 540M to be set.

When it is determined in step S706 that the receiving intensity is correct, the CPU 320 stores, in the storage area of the CPU 320, the reception data indicated by the received signal as toner information of the color identified (step S707). For example, the storage area of the CPU 320 is a storage area in the SRAM 340 or the like.

On the other hand, when it is determined in step S706 that the receiving intensity is not correct, the CPU 320 sets the toner color error flag to 1, which indicates that a toner bottle of a different color is erroneously set (step S708).

Subsequently, the CPU 320 determines whether all the error flags are set to 0 (step S709). When it is determined in step S709 that any error flag is set to 1, the CPU 320 performs an error process (step S710). Specifically, during the error process, the CPU 320 displays on the operation panel a message indicating that the toner bottle is not placed in the right portion, or a message indicating that a toner bottle of a different color is erroneously set, etc.

When it is determined in step S709 that all the error flags are set to 0 (not set to 1), the CPU 320 terminates the process of identifying of the toner bottle.

Alternatively, the determination of the toner remaining quantity may be performed after the toner information is stored in the storage area in the CPU 320. For example, if the process of FIG. 7 is performed after the printing job by the image forming device 10 is completed, the toner information of the toner bottle 540 is stored in the storage area in the CPU 320. When the toner remaining quantity contained in the stored toner information at this time is larger than a predetermined threshold value, the CPU 320 determines that the toner remaining quantity is sufficient. On the other hand, when the toner remaining quantity at this time is smaller than the predetermined threshold value, the CPU 320 determines that the toner remaining quantity is insufficient.

In this embodiment, the toner information is stored in the memory unit 552 of the ID chip 550 as a data set including a group of items of information. The present disclosure is not limited to this embodiment. For example, an address of the memory unit 552 may be assigned for each of the items of information included in the toner information. In this case, the address corresponding to the item of information in the toner information to be acquired is included in the acquisition request transmitted from the CPU 320. For example, in a case where it is desired to acquire the toner remaining quantity, the CPU 320 may be arranged to transmit, to the ID chip 550, an acquisition request including the address indicating the location of the toner remaining quantity stored in the memory unit 552. Subsequently, the CPU 320 performs the steps S704-S710 in the process of FIG. 7. Similarly, in a case where it is desired to acquire the serial number of the toner bottle 540, the same processing may be performed. Namely, when the toner information is stored in the memory unit 552 for each of the items of information included therein, an acquisition request including the address corresponding to the item of information in the toner information to be acquired may be transmitted, and the steps S704-S710 in the process of FIG. 7 may be performed for each transmission of the acquisition request.

As described in the foregoing, according to the image forming device of this embodiment, a signal indicating the toner information, which signal is in a predetermined range of voltage, is transmitted from each of the toner bottles to the CPU 320, and the color of the toner of each toner bottle can be identified based on the range of voltage of the received signal, even if color information is not contained in the toner information. Therefore, in this embodiment, it is not necessary to include the color information of each toner bottle in the toner bottle, and the storage capacity of the ID chip provided in the toner bottle can be reduced. Hence, it is possible to effectively reduce the cost of the ID chip provided in the toner bottle.

In this embodiment, the acquisition requests of toner information are transmitted to the toner bottles at distinctly different intervals through the connectors corresponding to the different colors of the toner bottles. Therefore, it is possible to determine whether the toner bottle of interest is set in the right portion based on the acquisition request transmitted in the timing corresponding to each color and the range of voltage of the signal indicating the reception data received in response to the acquisition request. For example, when an acquisition request is transmitted through the connector corresponding to the toner bottle of the Y toner but the received signal indicating the reception data is in the range of voltage predetermined for the M toner, it can be determined that the toner bottle of the M toner is erroneously set in the portion where the toner bottle of the Y toner should be set.

Next, a second embodiment of the present disclosure will be described. The second embodiment of the present disclosure differs from the first embodiment in that the data communication between each toner bottle and the toner control unit is performed by means of wireless communication. In the following, only a point of the second embodiment differing from the first embodiment will be described. In the second embodiment, the elements which are essentially the same as corresponding elements in the first embodiment are designated by the same reference numerals, and a description thereof will be omitted.

Figure 8:
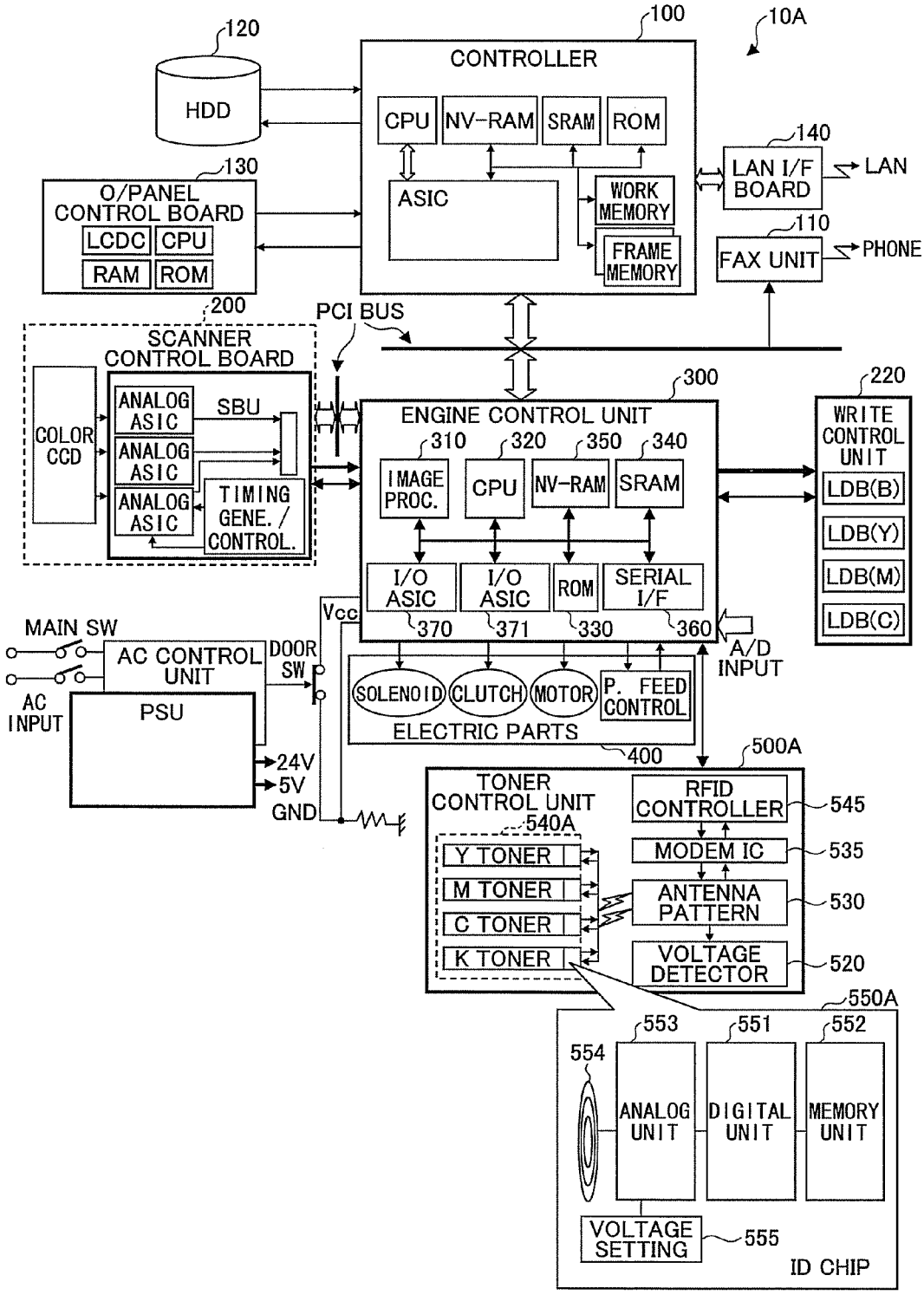
FIG. 8 is a diagram for explaining an image forming device of a second embodiment of the present disclosure.

FIG. 8 is a diagram for explaining the image forming device of the second embodiment. As illustrated in FIG. 8, the toner control unit 500A of this embodiment includes an antenna pattern 530, a modem IC (integrated circuit) 535, and an RFID controller 545, in addition to the voltage detector 520 as in the first embodiment.

The antenna pattern 530 transmits a signal indicating an acquisition request to or receives a signal indicating toner information from each of the ID chips 550A provided in the toner bottles 540 by means of RFID communication. The modem IC 535 carries out the modulation/demodulation of the information indicated by the signal to be transmitted to the antenna pattern 530 or by the signal received from the antenna pattern 530. The RFID controller 545 receives the signal indicating the acquisition request from the engine control unit 300 or transmits the signal indicating the toner information to the engine control unit 300 via the serial interface.

In addition to the digital unit 551 and the memory unit 552 as in the first embodiment, the ID chip 550A of this embodiment includes an analog unit 553, an antenna unit 554, and a voltage setting unit 555. The analog unit 553 controls data communication and power generation and generates a voltage in a predetermined range. The antenna unit 554 performs data communication between the toner control unit 500A and the ID chips through the antenna pattern 530. The voltage setting unit 555 sets up the range of the voltage to be generated by the analog unit 553.

The ID chip 550A of this embodiment causes the analog unit 553 to generate the voltage in the range set up by the voltage setting unit 555. The ID chip 550A transmits, to the toner control unit 500A, a signal with the generated voltage in the set-up range in which the toner information is carried.

Next, with reference to FIG. 9, the toner control unit 500A and the ID chips 550A in the image forming device of this embodiment will be described.

Figure 9:
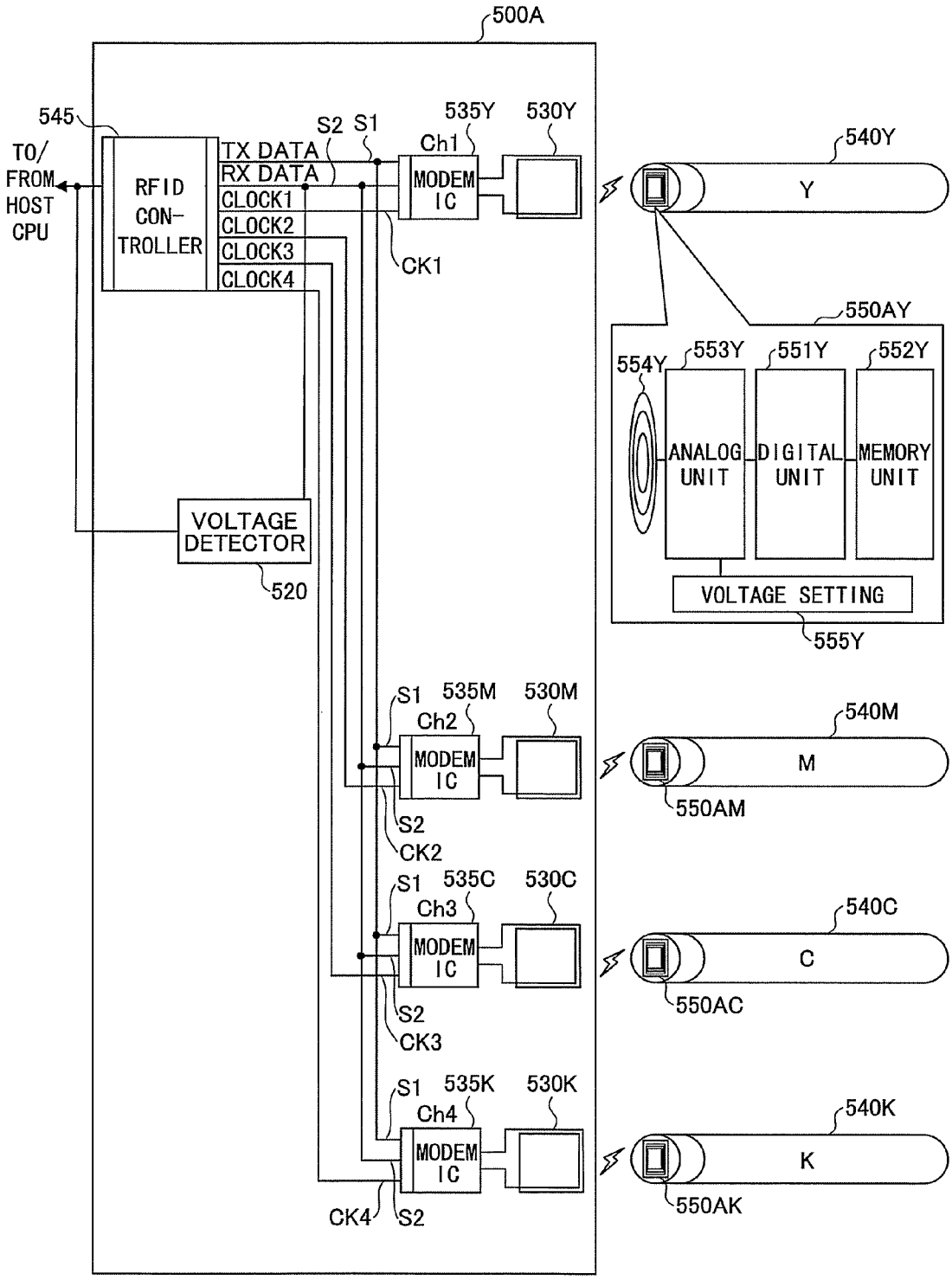
FIG. 9 is a diagram for explaining a toner control unit and ID chips in the image forming device of the second embodiment.

FIG. 9 is a diagram for explaining a toner control unit and ID chips in the image forming device of the second embodiment. As illustrated in FIG. 9, the toner control unit 500A of this embodiment includes a voltage detector 520, antenna patterns 530, modem ICs 535, and an RFID controller 545.

The antenna patterns 530 of this embodiment include respective antenna patterns corresponding to the toners of the four different colors. Specifically, the antenna patterns 530 include an antenna pattern 530Y corresponding to the Y toner bottle 540Y, an antenna pattern 530M corresponding to the M toner bottle 540M, an antenna pattern 530C corresponding to the C toner bottle 540C, and an antenna pattern 530K corresponding to the K toner bottle 540K.

Similarly, the modem ICs 535 of this embodiment corresponding to the respective antenna patterns 535 are provided in the toner control unit 500A. Specifically, the modem ICs 535 of this embodiment include a modem IC 535Y corresponding to the antenna pattern 530Y, a modem IC 535M corresponding to the antenna pattern 530M, a modem IC 535C corresponding to the antenna pattern 530C, and a modem IC 535K corresponding to the antenna pattern 530K.

On the other hand, a single RFID controller 545 is provided in the toner control unit 500A of this embodiment. The RFID controller 545 is connected to the CPU 320 of the engine control unit 300 via the serial interface. Transmission data, reception data and clock signals are exchanged between the RFID controller 545 and the CPU 320.

In this embodiment, the signal line S1, the signal line S2, and the clock signal lines CK are connected to each of the modem ICs 535. The signal line S1 is a signal line for supplying the transmission data, sent to the toner bottle 540 by the CPU 320, to the RFID controller 545. The signal line S2 is a signal line for supplying the toner information, received from each ID chip 550A, to the CPU 320. Each of the clock signal lines CK is a clock signal line for supplying a clock signal, sent by the CPU 320, to a corresponding one of the modem ICs 535.

The signal line 52 is connected to the input of the voltage detector 520. The output of the voltage detector 520 is connected to the CPU 320.

The clock signal lines CK1, CK2, CK3 and CK4 are respectively connected to the corresponding modem ICs 535Y, 535M, 535C and 535K of this embodiment.

Next, the ID chip 550A will be described. In FIG. 9, an ID chip 550AY provided in the Y toner bottle 540Y is illustrated as an example of the ID chips 550A provided in the four toner bottles 540. The ID chips 550AM, 550AC and 550AK have the same composition as that of the ID chip 550AY, and a description thereof will be omitted.

The ID chip 550AY includes a digital unit 551Y, a memory unit 552Y, an analog unit 553Y, an antenna unit 554Y, and a voltage setting unit 555Y.

The ID chip 550AY causes the antenna unit 554AY to receive an acquisition request of toner information from the antenna pattern 530Y. If the acquisition request is received at the antenna unit 554AY, the ID chip 550AY transfers the acquisition request to the memory unit 552Y through the analog unit 553Y and the digital unit 5511. In response to the acquisition request, a signal with the voltage in the predetermined range generated by the analog unit 553Y, in which the toner information stored in the memory unit 552Y is carried, is transmitted from the memory unit 552Y to the toner control unit 500A. The range of the voltage generated by the analog unit 553Y is set up beforehand by the voltage setting unit 555Y. It is preferred that, for example, at a time of the shipment of the toner bottle 540Y, the range of the voltage is set up by the voltage setting unit 555Y based on the reference voltages Vref1-4 used in the voltage detector 520 of the toner control unit 500A. For example, the voltage setting unit 555Y may be formed by using a variable resistor.

In the image forming device of this embodiment which makes use of the wireless communication, the identifying of a toner bottle is carried out in the same manner as in the first embodiment, and it is possible to reduce the amount of information to be stored in the storage areas in the ID chips 550A of the toner bottle. Therefore, it is possible for this embodiment to provide the advantageous effects which are the same as in the first embodiment.

In the image forming device of this embodiment, the color information of the toner is not contained in the toner information transmitted from the ID chips 550A, and the amount of information transmitted can be reduced from the amount of information transmitted according to the related art. It is possible to reduce the burdens on the data communication.

As described in the foregoing, according to the present disclosure, it is possible to effectively reduce the amount of information to be stored in the storage areas of the toner bottles in the image forming device.

The present disclosure is not limited to the above-described embodiments, and variations and modifications may be made without departing from the scope of the present disclosure.

The present application is based on Japanese patent application No. 2010-009383, filed on Jan. 19, 2010, the contents of which are incorporated herein by reference in their entirety.

What is claimed is:

1. An image forming device in which a plurality of objects of interest are detachably disposed, each of the plurality of objects having a storage area to store object-related information of the object, and a returning unit to return, in response to an acquisition request, a signal with a voltage in a predetermined range which is distinctly different among the plurality of objects, the signal carrying the object-related information of the object, the image forming device comprising:

a transmitting unit to transmit acquisition requests of object-related information to the plurality of objects respectively;

a receiving unit to receive signals from the plurality of objects respectively;

a voltage detection unit to detect a range of voltage of each of the signals received by the receiving unit; and an identifying unit to identify each of the plurality of objects, respectively, based on the ranges of voltage detected by the voltage detection unit.

2. The image forming device according to claim 1, wherein the identifying unit identifies each of the plurality of objects based on an association table in which a timing by which each of the acquisition requests is transmitted by the transmitting unit, each of the ranges of voltage detected by the voltage detection unit, and identification information of each of the plurality of objects are respectively associated.

3. The image forming device according to claim 2, wherein the voltage detection unit comprises a plurality of voltage comparators having mutually different reference voltages, each of which compares the voltage of each of the signals from the plurality of objects with a corresponding one of the reference voltages, and the association table is arranged so that the timing by which each of the acquisition requests is transmitted, each of output patterns from the plurality of voltage comparators, and the identification information of each of the plurality of objects are respectively associated.

4. The image forming device according to claim 1, wherein the transmitting unit transmits the acquisition requests to the plurality of objects respectively in accordance with mutually asynchronous clocks, and the receiving unit receives each of the signals from the plurality of objects within a predetermined time in response to a corresponding one of the acquisition requests which has been transmitted by the transmitting unit.

5. An identifying device which is connected to a plurality of objects of interest via a wired or wireless network, each of the plurality of objects having a storage area storing object-related information of the object respectively, the identifying device comprising:

a transmitting unit to transmit acquisition requests of object-related information to the plurality of objects respectively at different intervals;

a receiving unit to receive signals from the plurality of objects respectively, each of the plurality of objects returning, in response to a corresponding one of the acquisition requests, a signal with a voltage in a predetermined range which is distinctly different among the plurality of objects, the signal carrying the object-related information of the object;

a voltage detection unit to detect a range of voltage of each of the signals received by the receiving unit; and an identifying unit to identify each of the plurality of objects, respectively, based on the ranges of voltage detected by the voltage detection unit.

6. A semiconductor integrated device disposed in an object which is identified by the identifying device according to claim 5, the semiconductor integrated device comprising:

a storage area in which object-related information of the object is stored;

a returning unit to return, in response to an acquisition request received from the identifying device, a signal having a voltage in a predetermined range and indicating the object-related information of the object, to the identifying device;

a setting unit to set up a range of the voltage of the signal returned by the returning unit; and a voltage generating unit to generate the voltage of the signal in the predetermined range.

7. An identifying method performed by an image forming device in which a plurality of objects of interest are detachably disposed, each of the plurality of objects having a storage area to store object-related information of the object, and a returning unit to return, in response to an acquisition request, a signal with a voltage in a predetermined range which is distinctly different among the plurality of objects, the signal carrying the object-related information of the object, the identifying method comprising:

transmitting, by a transmitting unit of the image forming device, acquisition requests of object-related information to the plurality of objects respectively;

receiving, by a receiving unit of the image forming device, signals from the plurality of objects respectively;

detecting, by a voltage detection unit of the image forming device, a range of voltage of each of the signals received in the receiving; and identifying, by an identifying unit of the image forming device, each of the plurality of objects respectively, based on the ranges of voltage detected in the detecting.

* * * * *